US009719730B1

(12) United States Patent
Paknia

(10) Patent No.: US 9,719,730 B1
(45) Date of Patent: Aug. 1, 2017

(54) ENGINE CONVERSION SYSTEM

(71) Applicant: Paknia Engineering, PC, New York, NY (US)

(72) Inventor: Edouard Paknia, Weston, CT (US)

(73) Assignee: Paknia Engineering, PC, New York, NY (US)

( * ) Notice: Subject to any disclaimer, the term of this patent is extended or adjusted under 35 U.S.C. 154(b) by 509 days.

(21) Appl. No.: 14/521,180

(22) Filed: Oct. 22, 2014

(51) Int. Cl.
*H02K 44/08* (2006.01)
*F28D 7/00* (2006.01)
*F28F 1/00* (2006.01)

(52) U.S. Cl.
CPC ..... *F28D 7/0008* (2013.01); *F28F 1/00* (2013.01)

(58) Field of Classification Search
CPC ..... H02K 7/18; H02K 7/181; H02K 7/1815; H02K 7/188; H02K 7/1884; H02K 7/189; H02K 7/1892; H02K 44/08; H02K 44/085; H02K 99/10; F02G 1/04; F02G 1/043; F02G 1/0435; F01C 1/34; F01C 1/344; F01C 1/06; F01C 21/106; F01D 1/34; F01K 7/00
See application file for complete search history.

(56) References Cited

U.S. PATENT DOCUMENTS 3,149,247 A 9/1964 Cobine
3,517,229 A 6/1970 Bidard
3,802,196 A 4/1974 Franklin
3,859,789 A * 1/1975 Fawcett ..... F01C 1/063 418/33
4,385,498 A * 5/1983 Fawcett ..... F01C 1/063 60/649
4,454,436 A 6/1984 Last
5,006,060 A 4/1991 Wells
7,043,925 B2 5/2006 Haberbusch
7,378,749 B2 5/2008 Moore
2007/0240419 A1 * 10/2007 Paknia ..... F01C 1/3442 60/645

* cited by examiner

*Primary Examiner* — Tran Nguyen
(74) *Attorney, Agent, or Firm* — Neustek Law Offices

(57) ABSTRACT

An energy conversion system which utilizes magneto-hydrodynamics for energy based on the Stirling cycle without any moving parts. The energy conversion system generally includes a containment chamber which includes no moving parts. A compressible gas traverses through four distinct sections of the containment chamber to allow for energy conversion based on the Stirling cycle. The first section performs constant volume heating of the medium, the second section performs isothermal expansion of the medium, the third section performs constant volume cooling of the medium, and the fourth section performs isothermal compression of the medium. Electrical conductors installed within the containment chamber and magnetic field placed adjacent to the electric conductors within the containment chamber will extract electrical energy from the moving compressed ionized gas (CIG) using the principle of magneto-hydrodynamics.

13 Claims, 7 Drawing Sheets

ENGINE CONVERSION SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

Field of the Invention

The present invention relates generally to an energy conversion system and more specifically it relates to an energy conversion system which utilizes a closed loop magneto-hydrodynamics based on the Stirling cycle without any moving parts. The embodiment converts heat generated by an external source directly into electric energy.

Description of the Related Art

Any discussion of the related art throughout the specification should in no way be considered as an admission that such related art is widely known or forms part of common general knowledge in the field.

Currently, one of the most commonly employed engines is the internal combustion engine. Heat is applied through combustion in the process of burning a fuel gas mixture. In such an internal combustion engine, the process of combustion takes place within the housing of the engine. This type of engine is widely used, especially within cars and trucks.

Internal combustion engines generally use a reciprocating piston configuration to achieve the required thermodynamic processing of the Otto cycle. A piston is displaced within the cylinder achieving intake, compression of combustion of fuel gas mixture, expansion and exhaust. Modifications have been introduced to the internal combustion engine based on the Otto cycle such as replacing pistons with rotors in a configuration known as the Wankel engine. All of the above devices, while suitable for their purposes, convert heat into mechanical energy by using moving parts such as pistons, rotors, turbomachinery, and the like.

In contrast, application of heat is made externally in energy conversion devices such as a steam engine based on the Rankine cycle or the Stirling engine where moving parts such as pistons and rotors are used to convert heat from an external source and convert it into mechanical energy. Current Stirling engines in the market use solar energy as external source. Many other heat sources may be used for the proposed invention such as geothermal heat source, nuclear, fossil fuel, hydrogen combustion, byproduct waste heat from various processing and power plants and solar energy.

Because of the inherent problems with the related art, there is a need for a new and improved energy conversion system which utilizes closed loop magneto-hydrodynamics within the containment chamber based on the Stirling cycle without any moving parts.

BRIEF SUMMARY OF THE INVENTION

The invention generally relates to an energy conversion system which includes a containment chamber which includes no moving parts. The medium or compressible ionized gas (CIG) at high pressure traverses through four distinct sections of the containment chamber to replicate the four thermodynamic processes based on the Stirling cycle.

A section performs isothermal expansion under constant temperature of the medium where the working gas absorbs heat from an external source and expands in this first section of the energy conversion device. Another section performs constant volume cooling of the medium where heat is absorbed from the gas through a regenerator and transferred internally to the fourth section of the device. Another section performs isothermal compression of the gas hence rejecting heat externally. The last section performs constant volume heating of the gas where heat is absorbed internally from the second section above. As heat is absorbed, the temperature rises in the gas where it enters the first section to complete the cycle. Electric conductors installed within the containment chamber adjacent to a magnetic field placed around and within the containment chamber will extract electrical energy from the moving conductor or gas using the principle of magneto-hydrodynamics.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
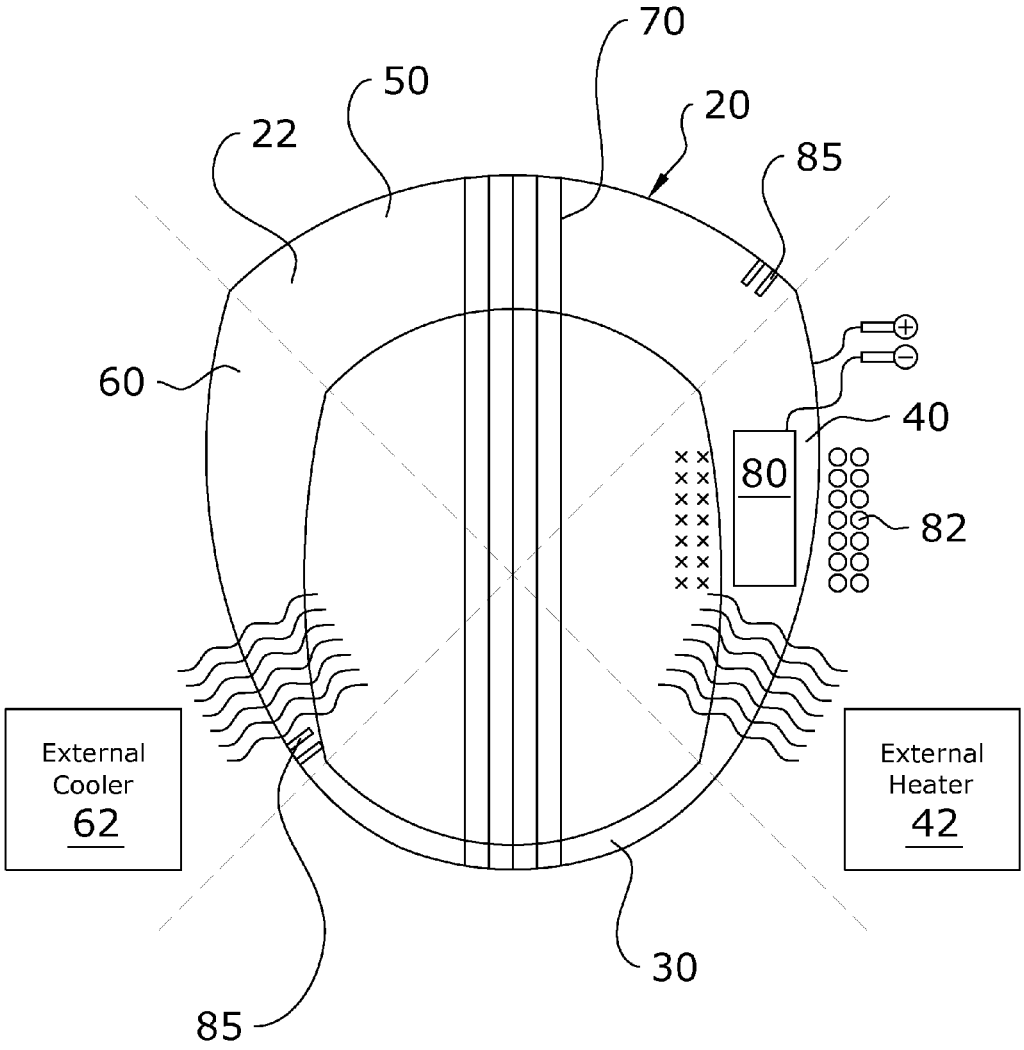
FIG. 1 is a frontal view of the present invention.

Turning now descriptively to the drawings, in which similar reference characters denote similar elements throughout the several views, the figures illustrates an energy conversion system 10, which comprises a containment chamber 20 which includes no moving parts. A compressible ionized acting as a moving conductor traverses through four distinct sections 30, 40, 50, 60 of the containment chamber 20 to allow for energy conversion based on the Stirling cycle. Section 30 performs constant volume heating of the medium, section 40 performs isothermal expansion of the medium, section 50 performs constant volume cooling of the medium, and the fourth section 60 performs isothermal compression of the medium. Electric conductors 80 installed within the containment chamber adjacent to magnetic field 82 placed around the containment chamber at section 40 will extract electrical energy from the moving medium or compressible ionized gas (CIG) acting as a moving conductor through the magnetic field using the principle of magneto-hydrodynamics.

B. Containment Chamber

As shown in FIG. 1, the present invention is generally housed within a containment chamber 20. The containment chamber 20 is a closed loop system that includes no moving parts such as shafts, cranks, crankshafts, pistons, rotors, blades, plungers, or vanes which may typically be used within other energy conversion systems. A compressible ionized gas (CIG) will travel through a passageway 22 within the containment chamber 20 and undergo at least four distinct thermodynamic processes for energy conversion as discussed herein.

The medium or compressible ionized gas (CIG) may be comprised of compressed air or compressed noble gas such as Helium, Neon, Argon, Krypton, Xenon or Radon. The gases above may be mixed with an assortment or combination of alkali metals such as lithium, sodium, potassium, rubidium, caesium etc. Once energized by high voltage probes 85 within the containment chamber 20, the gas mixture will be ionized, the alkali metal will vaporize and will act as a moving conductor traveling through the four distinct sections 30, 40, 50, 60 of the passageway 22 of the containment chamber 20 as described below The containment chamber 20 will preferably be hollow and will include a passageway 22 which generally comprises four distinct sections; a first section 30, a second section 40, a third section 50, and a fourth section 60. Each of the sections 30, 40, 50, 60 will perform its own thermodynamic process while the present invention is in use. Preferably, the first section 30 will perform constant volume heating, the second section 40 will perform isothermal expansion, the third section 50 will perform constant volume cooling, and the fourth section 60 will perform isothermal compression.

The first section 30 generally comprises a constant cross-section as shown in FIG. 1. The use of a constant cross-section within the first section 30 allows the volume of the gas to remain constant along the path of travel through the first section 30. As shown in FIG. 1, the cross-section of the first section 30 will generally be smaller than the cross-section of the other sections 40, 50, 60 of the containment chamber 20.

An internal heat exchanger 70, such as a regenerator, will internally extract heat from gas travelling through the third section 50 and transfer the heat to the gas as it passes through the first section 30. This internally-applied heat will allow for the constant volume heating of the gas within the first section 30. Various types of heat exchangers 70 or regenerators may be used internally as heat is applied uniformly to the medium as it passes through the first section 30. Such regenerators may be made of flat plate, tube and shell heat exchangers or a heat exchange medium such heat sink composed of salts, high temperature conducting fluids, or metal mesh may be used as the regenerator to accomplish the transfer of heat from the third section 50 to the first section 30 within the containment chamber.

The second section 40 of the containment chamber 20 is connected directly with the first section 30 of the containment chamber 20 as shown in FIG. 1. The second section 40 includes an increasing cross-sectional area which increases along the path of travel between the first section 30 and third section 50. The second section 40 starts with a cross-sectional area equal to the cross-sectional area of the uniform first section 30. The cross-sectional area then gradually increases along the path of travel of the medium to allow for isothermal expansion of the medium. External heat is applied to the second section 40 from an external heater 42 where expansion of the gas occurs.

The third section 50 of the containment chamber 20 is connected directly with the second section 40 of the containment chamber 20 as shown in FIG. 1. The third section 50 comprises an unchanged and constant cross-sectional area to maintain a constant volume along the path of travel of the gas. However, it should be noted that the cross-sectional area of the third section 50 is by design larger than that of the cross section of the first section 30 as illustrated in the FIGS. 1 and 2.

This design configuration allows for the constant volume cooling which is performed on the compressible medium as it traverses the third section 50 of the containment chamber 20. An internal heat exchanger or regenerator 70 will internally extract heat from the gas travelling through the third section 50 and transfers the heat to the gas as it passes through the first section 30. This internal removal of heat will allow for the constant volume cooling of the gas in the third section 50.

Various types of heat exchangers or regenerators may be used to internally extract heat from the gas at the third section 50 and transfer to the gas at the first section 30. It shall be noted that depending on design parameters, different pressure ratios may be incorporated. e.g. for a compression ratio of 5:1, the cross section at the third section 50 shall be five times larger than the cross section of the first section 30.

Figure 2:
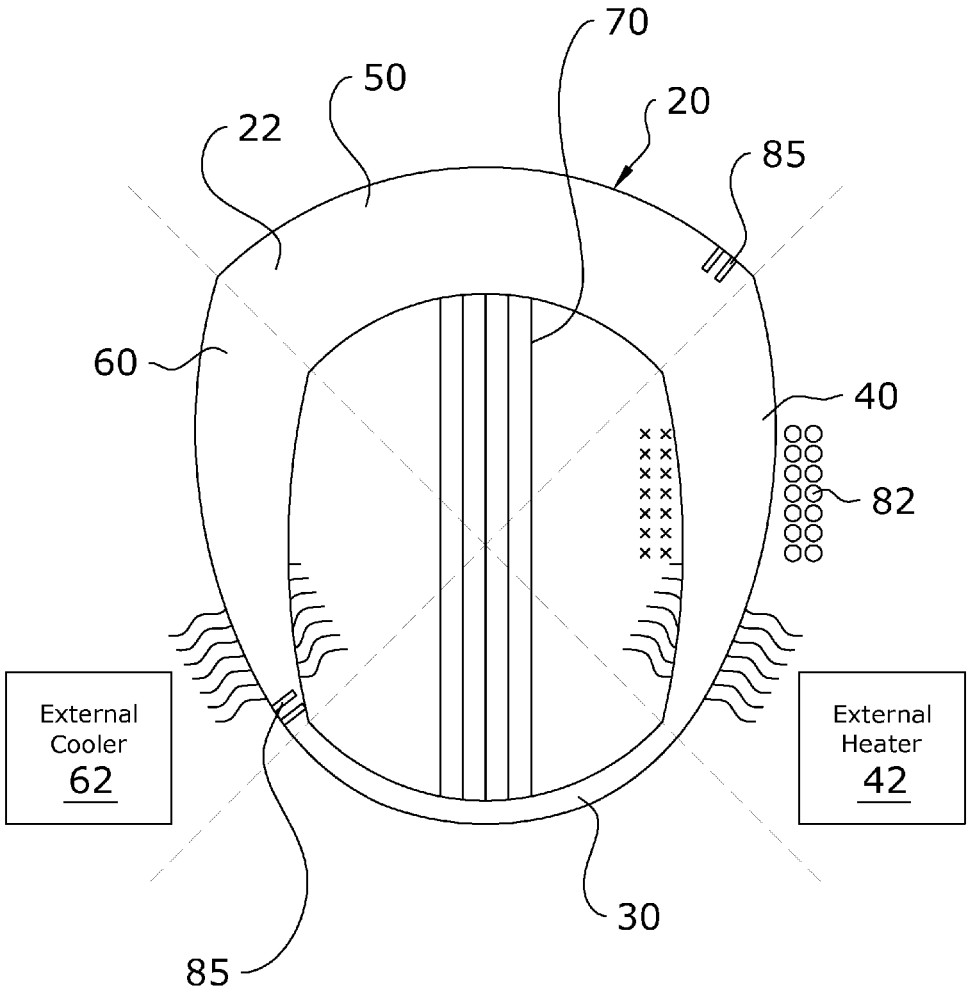
FIG. 2 is a longitudinal section of the present invention.
Figure 3:
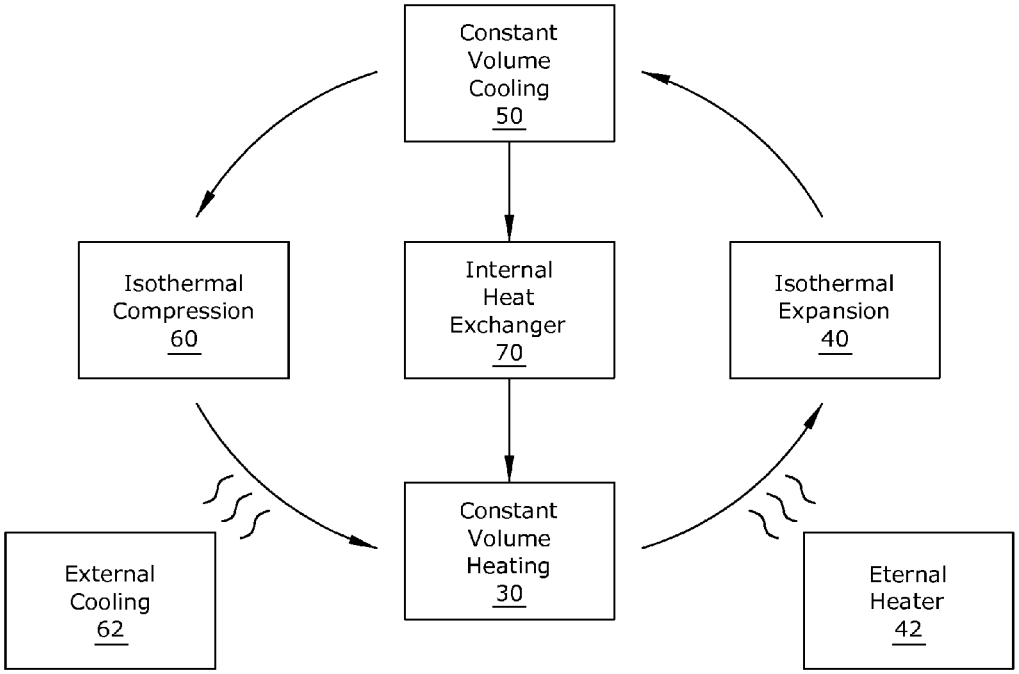
FIG. 3 is a block diagram of the present invention.

The fourth section 60 of the containment chamber 20 is connected directly with the third section 50 of the containment chamber 20 as shown in FIGS. 1-3. The fourth section 60 is also directly connected to the first section 30 of the containment chamber 20 to complete the closed looped cycle.

The fourth section 60 includes a cross-sectional area which decreases along a path between the third section 50 and first section 30. At its junction with the third section 50, the cross-sectional area of the fourth section 60 is equal to that of the third section 50 before decreasing in cross-sectional area to be equal to the first section 30 at its junction therewith. The total volume of the fourth section 60 is equal to the total volume of the second section 40 but with decreasing and increasing cross-sectional areas along the paths of each section, respectively. The fourth section 60 is adapted to allow for isothermal compression of the gas. An external cooler 62 will extract heat from the gas medium as it passes through the fourth section 60 and transfer it to outside of the containment chamber 20. This will allow for the constant volume cooling of the gas within the fourth section 60. Various types of external coolers 62 may be utilized so long as cooling is applied uniformly to the medium as it passes through the fourth section 60.

The containment chamber 20 includes an internal heat exchanger or regenerator 70 between the second section 30 and the fourth section 50 as shown in the figures. The regenerator 70 will remove heat from the gas within the third section 50 and transfer that heat to the gas within the first section 30 of the containment chamber 20.

The containment chamber 20 may include high voltage probes 85 which are utilized to electrically charge and ionize the gas as it passes through the various sections 30, 40, 50, 60 of the present invention. These probes 85 may comprise various configuration, sizes, and placements. The figures illustrate the probes 85 being positioned at the intersection of the first and fourth sections 30, 60 and at the intersection of the second and third sections 40, 50. While this is a preferable configuration, it should be appreciated that different embodiments may utilize different configurations or placement for the probes 85.

A magnetic field 82 may also be applied to the second section 40 of the containment chamber 20 adjacent to electrical conductors 80. The electric conductors 80 will extract an electric DC current from the expanding and travelling gas in the second section 40 to perform the magneto-hydrodynamic energy conversion process. As the gas expands and travels through the second section 40, acting as a current carrying conductor travelling through the magnetic field 82, a direct current will be generated that will be harnessed at the electric conductors 80.

C. Operation of Preferred Embodiment

Figure 4:
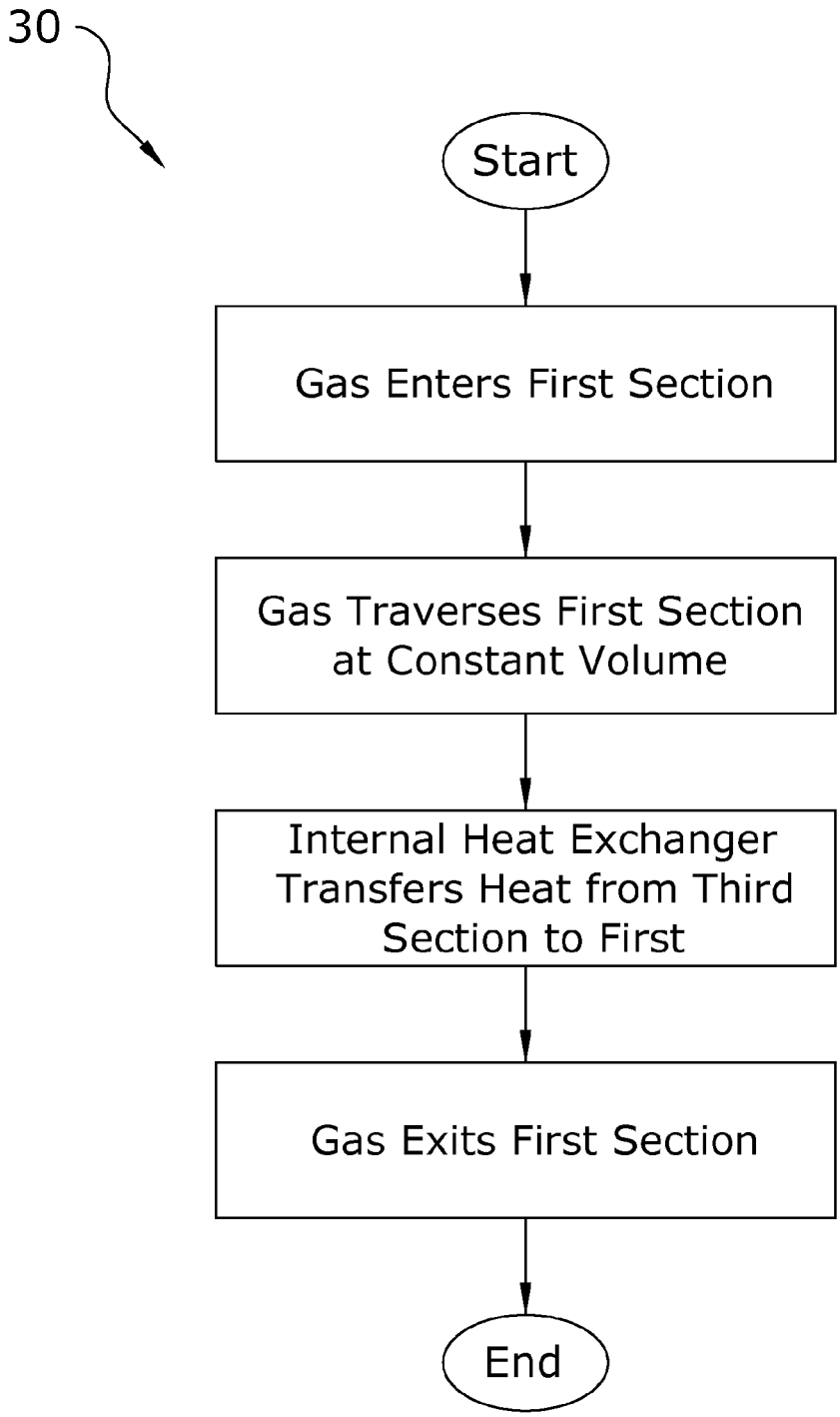
FIG. 4 is a flowchart illustrating the first section of the present invention.

FIGS. 4-8 illustrate exemplary flowcharts showing functionality of one embodiment of the present invention. As shown in FIG. 4, a compressible ionized gas will traverse a continuous path within the containment chamber 20 to allow for energy conversion based on the Stirling cycle. The compressible ionized gas will maintain constant volume as it travels through the first section 30. Internal heat extracted from gas at the third section 50 will be applied to the first section 30 via regenerator 70 inducing the constant volume heating of the gas as it passes through the first section 30 prior to entering the second section 40.

Figure 5:
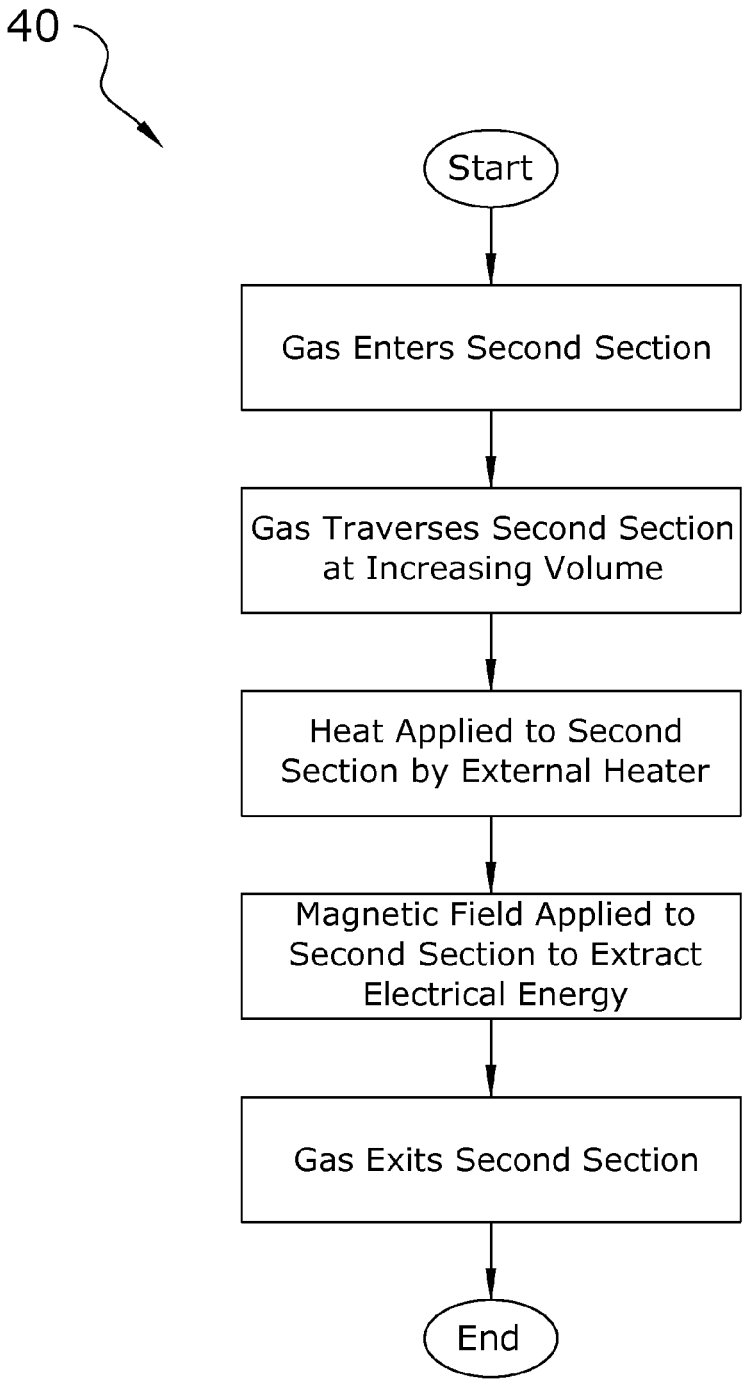
FIG. 5 is a flowchart illustrating the second section of the present invention.

As shown in FIG. 5, as the gas enters the second section 40 of the containment chamber 20, the volume of the medium will be increased and the medium will both expand and accelerate as heat is added from an external source to the gas via a heat exchanger 42. This will allow for the isothermal expansion of the gas wherein its volume will increase while temperature remains constant. Within the second section 40 immediately after the external heat exchanger (heater) 42 the principle of magneto hydrodynamics is applied to extract electrical energy from the expanding gas acting as a moving conductor within a magnetic field.

Figure 6:
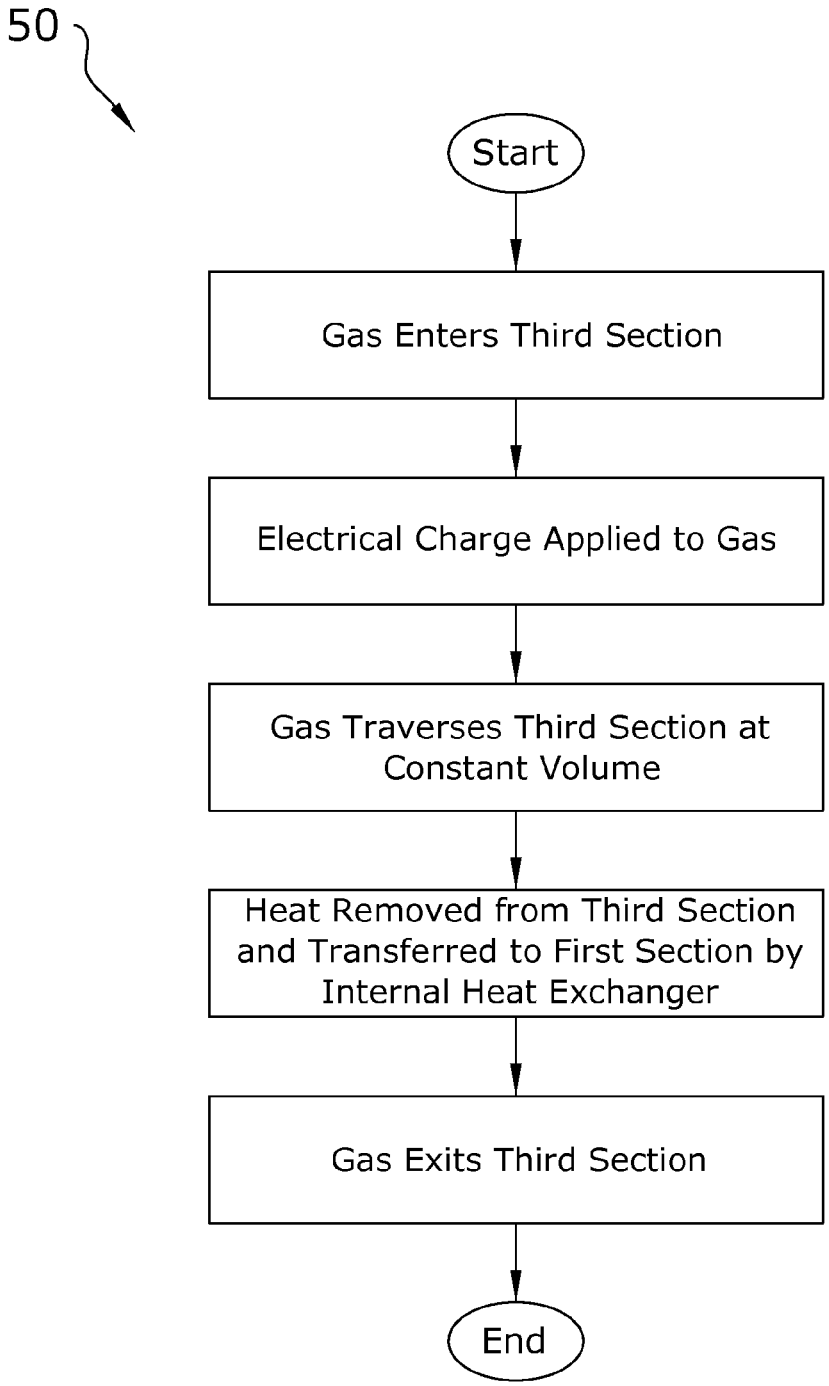
FIG. 6 is a flowchart illustrating the third section of the present invention.

As shown in FIG. 6, the medium which has been expanded in the second section 40 will enter the third section 50 where volume will remain constant. Internal cooling will be applied to the third section 50 via the regenerator 70 which will remove heat from the gas and transfer that heat to the gas travelling through section 30. While traversing the third section 50 the gas will undergo the third phase of constant volume cooling.

Figure 7:
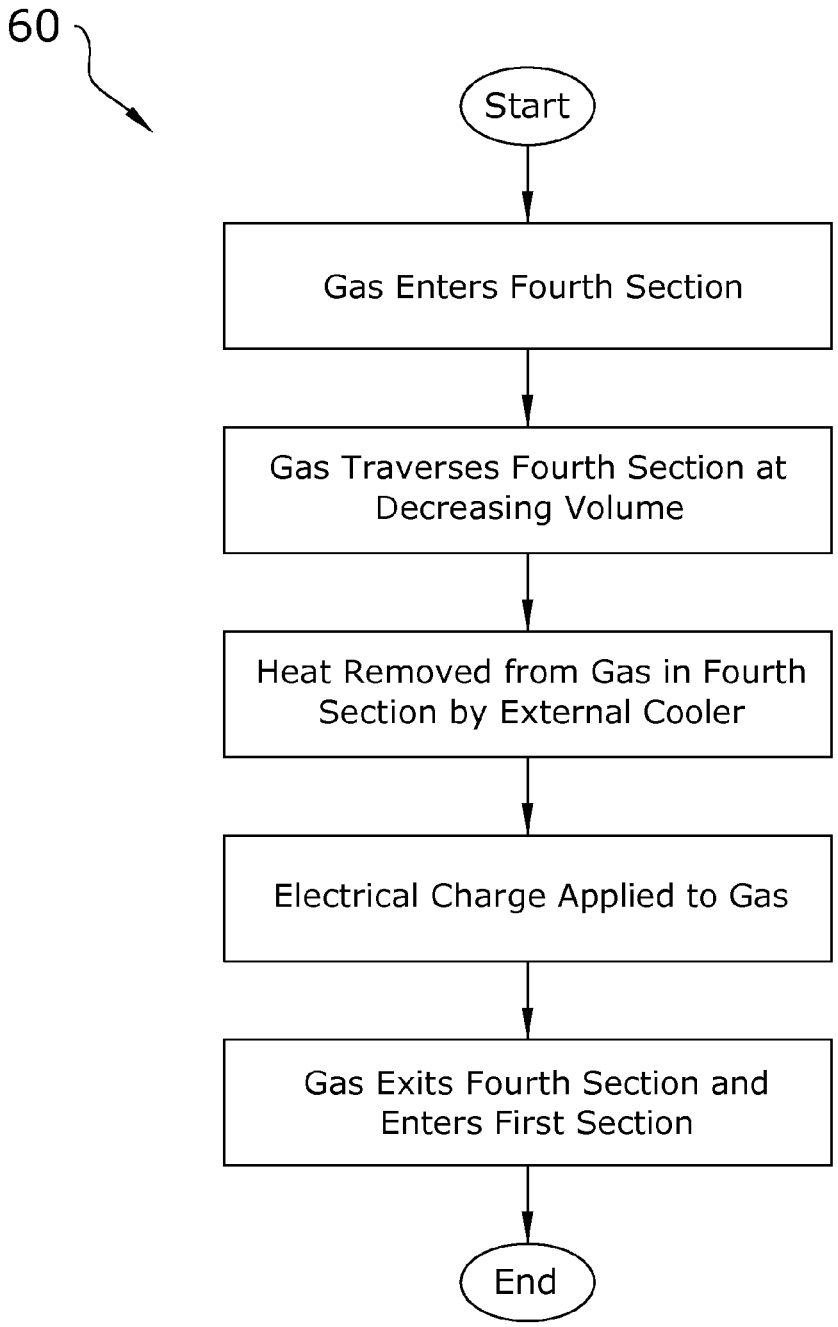
FIG. 7 is a flowchart illustrating the fourth section of the present invention.

As shown in FIG. 7, after being cooled within the third section 50, the medium will enter the fourth section 60 where volume will be decreased and the gas will be compressed. As the gas is being compressed within the fourth section 60, heat will be removed via the external cooler 62 where the heat from gas will be discharged externally. The medium will undergo isothermal compression as it traverses and heat is extracted in the fourth section 60.

As the medium traverses through the containment chamber 20 and its sections 30, 40, 50, 60, the principle of magneto-hydrodynamics will be applied to extract electrical energy from the medium as it is in motion. The medium is electrically charged with the high voltage probes 85.

Once an electrical charge is applied, the gas will ionize and will act as an electrical conductor. Upon application of heat from an external heater 42, and application of cooling from an external cooler 62, the gas will move within the containment chamber 20. The gas will act a as a moving conductor through a magnetic field where as a result electrical energy can be extracted from the device.

In an alternate embodiment, the present invention may function as a cooling or refrigeration device where electric energy is applied and heat extracted from the external source therefore cooling the external source. In this embodiment electric energy is supplied at the electric conductors 80 therefore accelerating the ionized compressible gas through the containment chamber 20. As gas is forced to travel the containment chamber 20, heat will be extracted at the second section 40 through external heat exchanger 42 and rejected to the outside at the fourth section 60 through the external cooler 62. This will allow for cooling of any medium exposed to the second section 40. This alternate embodiment will allow for cooling, refrigeration and cryo-cooling of mediums but will require the application of electric energy at the electric conductors 80.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. An energy conversion system, comprising:

a containment chamber including a passageway;

a first section of said passageway having a uniform cross-sectional area, wherein said first section is for performing constant volume heating of a medium via an internal heat exchange;

a second section of said passageway having an increasing cross-sectional area, wherein said second section is for performing isothermal expansion of said medium by application of heat;

a third section of said passageway having a uniform cross-sectional area, wherein said third section is for performing constant volume cooling of said medium by transferring heat to the first section through an internal heat exchanger; and a fourth section of said passageway having a decreasing cross-sectional area, wherein said fourth section is for performing isothermal compression of said medium by cooling.

2. The energy conversion system of claim 1, wherein said containment chamber includes no moving parts.

3. The energy conversion system of claim 1, wherein said medium is comprised of a gas.

4. The energy conversion system of claim 3, wherein said gas is selected from a group consisting of Helium, Neon, Argon, Krypton, Xenon or Radon.

5. The energy conversion system of claim 1, wherein said first section comprises a smaller cross-sectional area than said second section, said third section, or said fourth section.

6. The energy conversion system of claim 1, further comprising an external heater applying heat to said second section.

7. The energy conversion system of claim 6, further comprising an external cooler removing heat from said fourth section.

8. The energy conversion system of claim 1, wherein said third section comprises a cross-sectional area which is at least five times the cross-sectional area of said first section.

9. The energy conversion system of claim 1, further comprising one or more voltage probes for charging and ionizing said medium.

10. The energy conversion system of claim 9, wherein said one or more voltage probes comprises a first voltage probe adjacent to an intersection of said second section and said third section and a second voltage probe adjacent to an intersection of said fourth section and said first section.

11. The energy conversion system of claim 1, further comprising a magnetic field applied to said second section.

12. The energy conversion system of claim 11, further comprising one or more electrical conductors.

13. The energy conversion system of claim 12, wherein said one or more electrical conductors are positioned within said second section.

* * * * *